US008740562B2

(12) United States Patent
Takemoto et al.

(10) Patent No.: US 8,740,562 B2
(45) Date of Patent: Jun. 3, 2014

(54) AXIAL FAN AND METHOD OF MANUFACTURING THE SAME

(75) Inventors: Shinji Takemoto, Kyoto (JP); Yuichiro Yokoyama, Kyoto (JP); Shinya Kaneoya, Kyoto (JP)

(73) Assignee: Nidec Corporation, Kyoto (JP)

( * ) Notice: Subject to any disclaimer, the term of this patent is extended or adjusted under 35 U.S.C. 154(b) by 1078 days.

(21) Appl. No.: 12/738,662

(22) PCT Filed: Oct. 29, 2008

(86) PCT No.: PCT/IB2008/054506

§ 371 (c)(1), (2), (4) Date: Apr. 19, 2010

(87) PCT Pub. No.: WO2009/057063

PCT Pub. Date: May 7, 2009

(65) Prior Publication Data

US 2010/0209264 A1 Aug. 19, 2010

Related U.S. Application Data

(60) Provisional application No. 60/983,657, filed on Oct. 30, 2007.

(51) Int. Cl.
*F04D 19/00* (2006.01)

(52) U.S. Cl.
USPC ..... 415/220

(58) Field of Classification Search
CPC ..... F04D 19/002; F04D 25/08; F04D 25/12; F04D 27/0238; F04D 29/52; F04D 29/522; F04D 29/526; F04D 29/684
USPC ..... 415/119, 177, 220, 208.3, 208.2, 208.5; 416/93 R; 164/113, 137
See application file for complete search history.

(56) References Cited

U.S. PATENT DOCUMENTS

| | | | |
|---|---|---|---|
| 5,288,203 | A | 2/1994 | Thomas |
| 5,707,205 | A | 1/1998 | Otsuka |
| 6,132,171 | A | 10/2000 | Fujinaka et al. |
| 6,179,562 | B1 | 1/2001 | Fujinaka |
| 6,183,196 | B1 | 2/2001 | Fujinaka |
| 6,254,342 | B1 | 7/2001 | Fujinaka et al. |

(Continued)

FOREIGN PATENT DOCUMENTS

| | | | |
|---|---|---|---|
| JP | 01-249982 | A | 10/1989 |
| JP | 04-183998 | A | 6/1992 |

(Continued)

OTHER PUBLICATIONS

Official Communication issued in International Patent Application No. PCT/IB2008/054506, mailed on Apr. 14, 2009.

*Primary Examiner* — Nathaniel Wiehe
*Assistant Examiner* — Adam W Brown
(74) *Attorney, Agent, or Firm* — Keating & Bennett, LLP

(57) ABSTRACT

A fan includes sloping surfaces arranged at an inner peripheral surface of an air channel portion that are shaped such that an air passage is enlarged in a cross sectional area in a direction normal or substantially normal to a central axis. The inner peripheral surface of the air channel portion also includes a straight surface at which area the distance between the central axis and the inner peripheral surface of the air channel portion is substantially constant. Also, the straight surface of the air channel portion includes a plurality of slits each penetrating the air channel portion.

18 Claims, 10 Drawing Sheets

(56) References Cited

U.S. PATENT DOCUMENTS

| | | | | |
|---|---|---|---|---|
| 6,332,755 | B1 | 12/2001 | Fujinaka et al. | |
| 6,406,258 | B1 | 6/2002 | Lin et al. | |
| 6,710,486 | B1 | 3/2004 | Horng et al. | |
| 6,796,768 | B2 * | 9/2004 | Fujinaka et al. | 415/208.5 |
| 7,063,504 | B2 * | 6/2006 | Huang et al. | 415/165 |
| 7,775,767 | B2 | 8/2010 | Takemoto et al. | |
| 7,835,149 | B2 | 11/2010 | Li et al. | |
| 2005/0265828 | A1 | 12/2005 | Horng et al. | |
| 2005/0281665 | A1 * | 12/2005 | Horng et al. | 415/60 |
| 2008/0225480 | A1 | 9/2008 | Kayama et al. | |
| 2008/0259564 | A1 | 10/2008 | Kayama et al. | |

FOREIGN PATENT DOCUMENTS

| | | | |
|---|---|---|---|
| JP | 11-193798 | A | 7/1999 |
| JP | 11-201084 | A | 7/1999 |
| JP | 2977530 | B2 | 11/1999 |
| JP | 2000-199500 | A | 7/2000 |
| JP | 2000-283095 | A | 10/2000 |
| JP | 2000-337296 | A | 12/2000 |
| JP | 2001-003900 | A | 1/2001 |
| JP | 3188397 | A | 7/2001 |
| JP | 3188417 | B2 | 7/2001 |
| JP | 3207379 | B2 | 9/2001 |
| JP | 3101363 | U | 6/2004 |
| JP | 2008-223563 | A | 9/2008 |
| JP | 2008-267176 | A | 11/2008 |
| JP | 2009-057943 | A | 3/2009 |
| TW | D105922 | S | 8/2005 |

* cited by examiner

AXIAL FAN AND METHOD OF MANUFACTURING THE SAME

BACKGROUND OF THE INVENTION

1. Field of the Invention

The present invention relates to improvements in air volume characteristics of axial fans.

2. Description of the Related Art

Along with sophistication of performance, recent electronics generate increasingly large amounts of heat from electronic components disposed inside the electronics. Fan devices are used along with these electronics in order to minimize hot air retention inside a housing and to discharge the hot air from inside the housing to the outside. In order to achieve good performance of the electronics, cooling inside the housing is essential.

Many electronic components are disposed inside of the housing of an electronic device. In this case, the large number of electrical components create a resistance in the flow passage of an airflow inside the housing. A fan device produces a maximum amount of air volume when the flow passage resistance is zero. Conversely, a fan device produces a minimum amount of air volume when the flow passage of the fan device is completely blocked due to the flow passage resistance. Since the fan device is under load because of the flow passage resistance in the electronic device, an actual air volume obtained is small when compared with the maximum air volume.

Two types of fan devices are primarily used in electronics: centrifugal fans and axial fans. Centrifugal fans provide high static pressure and are able to produce a given air volume stably even when the flow passage resistance within the housing is high. Centrifugal fans, however, produce smaller air volumes than axial fans. However, axial fans cannot provide as much static pressure as that of centrifugal fans, but the axial fans can produce greater air volumes.

An axial fan is chosen in cases where a large air volume is required to cool the inside of the housing of an electronic device. Axial fans are frequently used nowadays as a cooling unit for electronics.

Accordingly, there is a need for an improvement in air volume characteristics in an intermediate static pressure zone, i.e., the flow passage resistance, in an axial fan, in cases when an axial fan is used as a cooling unit for an electronic device. So far, attempts have been made to improve air volume characteristics through modifications of the shapes of blades in the axial fans.

SUMMARY OF THE INVENTION

Instead of modifying the shapes of blades, preferred embodiments of the present invention provide improved fans having modified air channel portions to improve air volume characteristics.

An axial fan according to a preferred embodiment of the present invention includes an impeller with a plurality of blades, a motor, a base, an air channel portion, and a plurality of supports. The plurality of blades are centered about a central axis and project radially outward from the central axis so as to be circumferentially arranged. The motor rotates the impeller around the central axis. The base supports the motor. The air channel portion encloses the impeller from a radially outer side in order to provide an air passage. The supports project radially outward from the base to be fixedly coupled to the air channel portion.

The air channel portion includes an upper opening at a first end and a lower opening at a second end, in a direction of the central axis. Each of the upper and lower openings has a region in which the air passage is increased toward each open end in cross-sectional area in a direction normal or substantially normal to the central axis direction. A straight portion is provided between the upper and lower openings, along which straight portion the air passage is substantially constant in cross-sectional area in the direction normal or substantially normal to the central axis direction. In the straight portion, a plurality of radially penetrating slits are arranged circumferentially with respect to the central axis. A longitudinal direction of the slits extending along an outer peripheral surface of the air channel portion is either parallel or substantially parallel to or forms an acute angle with the central axis direction.

With the above structure, an airflow that is drawn into the air channel portion greatly increases its flow rate when the airflow reaches the straight portion, so that relatively negative pressure occurs in the airflow with respect to atmospheric pressure. Due to this effect, air is taken through the slits provided in the air channel portion, and an increased volume of air is discharged axially from the axial fan.

Directions in which the slits penetrate are preferably parallel or substantially parallel to one another in each of the outer peripheral surfaces where the slits are provided, the outer peripheral surfaces corresponding to respective sides of the outer periphery of the air channel portion. In this configuration, an airflow is drawn into the air channel portion through the slits with only a small amount of energy loss, which further increases the air volume discharged from the axial fan.

Other features, elements, advantages and characteristics of the present invention will become more apparent from the following detailed description of preferred embodiments thereof with reference to the attached drawings.

DETAILED DESCRIPTION OF THE PREFERRED EMBODIMENTS

Figure 1:
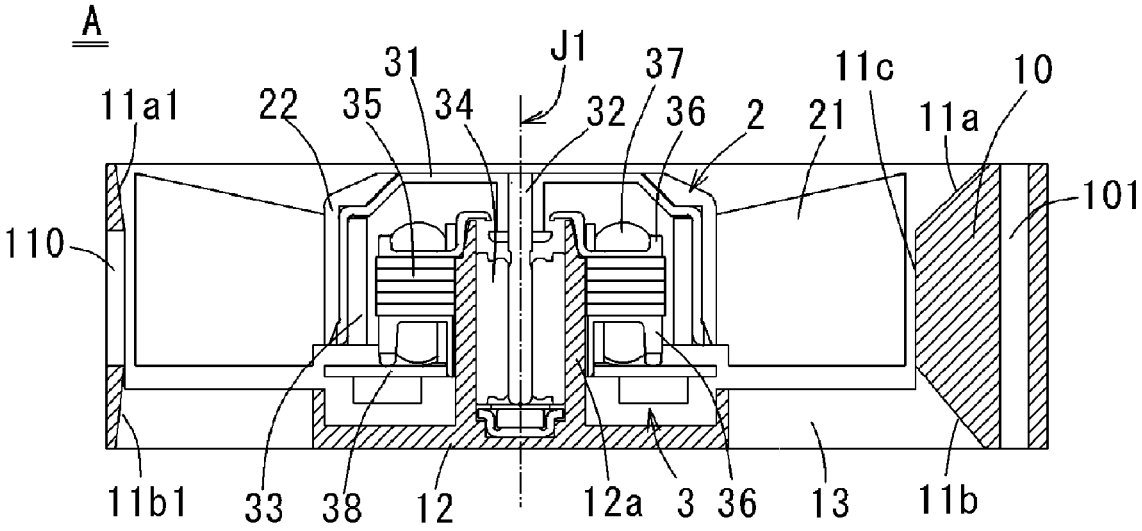
FIG. 1 is a cross-sectional view of an axial fan, illustrating a preferred embodiment of the present invention.

Referring to FIGS. 1 through 9, preferred embodiments of the present invention will be described in detail. It should be noted that in the explanation of the preferred embodiments of the present invention, when positional relationships among and orientations of the different components are described as being up/down or left/right, ultimately positional relationships and orientations that are in the drawings are indicated, positional relationships among and orientations of the components once having been assembled into an actual device are not indicated. Meanwhile, in the following description, an axial direction indicates a direction parallel or substantially parallel to a central axis J1, and a radial direction indicates a direction normal or substantially normal to the central axis J1.

First Preferred Embodiment

Figure 2:
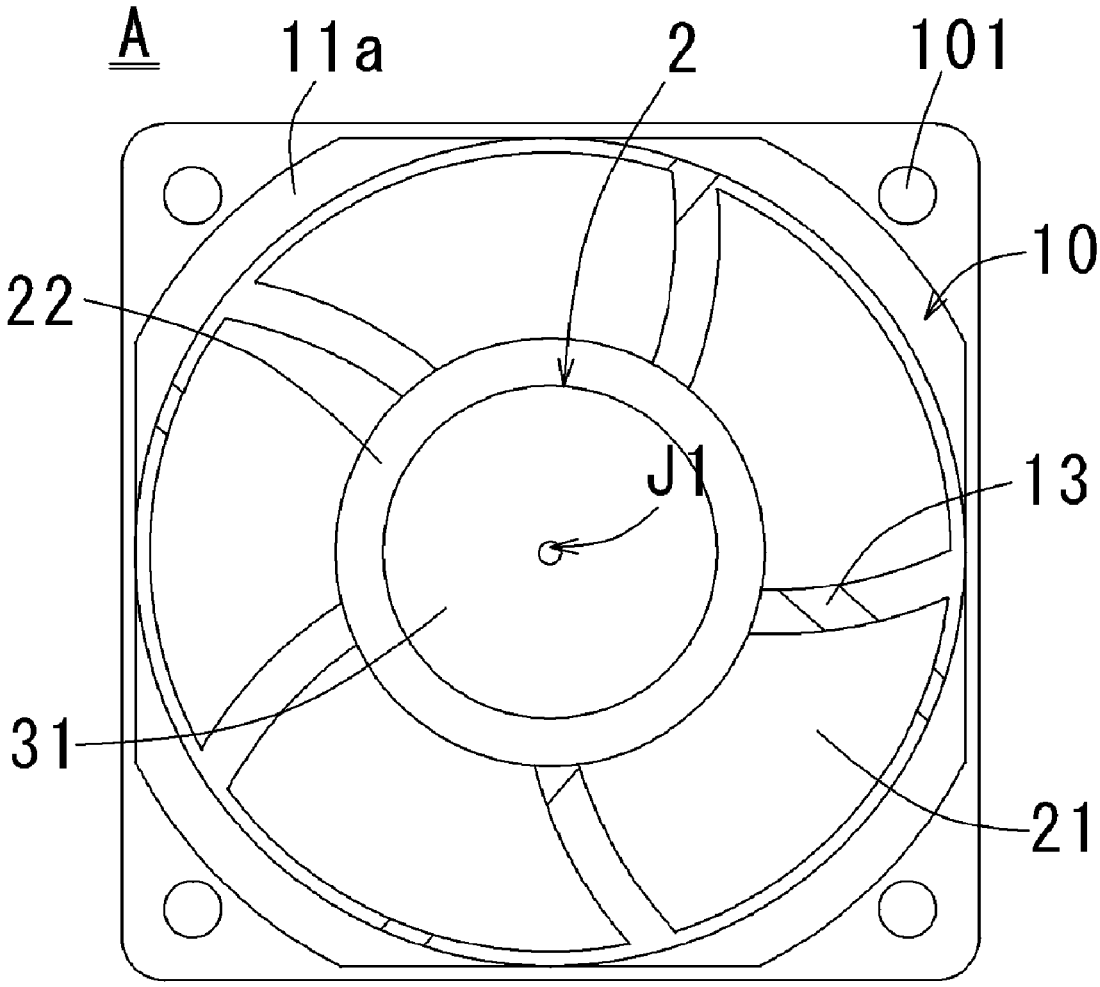
FIG. 2 is a plan view of the axial fan according to the preferred embodiment of the present invention as viewed from the upper side in FIG. 1 in a direction of a central axis.

FIG. 1 is a cross-sectional view of an axial fan A, illustrating a preferred embodiment of the present invention. FIG. 2 is a plan view of the axial fan A according to a preferred embodiment of the present invention as viewed from the upper side in FIG. 1 in a direction of the central axis J1.

A rotor of the axial fan A is constructed such that an impeller 2 is attached to the outer surface of a covered and substantially cylindrical rotor yoke 31. The structure of the impeller 2 will be described later. A shaft 32 has its first end fixedly fastened to the rotor yoke 31. The rotor yoke 31 is rotated about the shaft 32. The rotation axis of the shaft 32 is the central axis J1. The rotor yoke 31 houses a motor 3 therein.

The impeller 2 is enclosed by an air channel portion 10 from the radially outer side. The inner peripheral surface of the air channel portion 10 forms a substantially cylindrical shape. That is, the air channel portion 10 provides an air passage arranged to direct airflows that are produced when the impeller 2 is rotated around the central axis J1. A contact-preventive gap is provided radially between blades 21 and the air channel portion 10. The outer shape of the air channel portion 10 preferably is substantially quadrangular as shown in FIG. 2. An attachment hole 101 arranged to attach the axial fan A to an electronic device or the like is preferably provided at each of four corners of the air channel portion 10. The attachment holes 101 penetrate through the four corners of the air channel portion 10 in a direction of the central axis J1.

The air channel portion 10 includes an upper opening and a lower opening at its upper end and lower end, respectively. Sloping surfaces 11*a* and 11*a*1 are provided in the upper opening of the air channel portion 10 so that the air passage is gradually enlarged in cross-sectional area in a direction normal or substantially normal to the central axis J1, toward the upper end of the air channel portion 10. That is, the sloping surfaces 11*a* and 11*a*1 become separated from the central axis J1 toward the upper side in the central axis J1 direction. Particularly, the sloping surfaces 11*a* constitute a portion of a circular conical surface substantially centered at the central axis J1.

Sloping surfaces 11*b* and 11*b*1 are provided in the lower opening of the air channel portion 10 so that the air passage is gradually enlarged in cross-sectional area in the direction normal or substantially normal to the central axis J1, toward the lower side in the central axis J1 direction. That is, the sloping surfaces 11*b* and 11*b*1 become separated from the central axis J1 toward the lower side in the central axis J1 direction. Particularly, the sloping surfaces 11*b* constitute a portion of a circular conical surface substantially centered at the central axis J1.

It should be noted that the sloping surfaces 11*a* and 11*b* are not limited to the circular conical surfaces as long as they have such a shape that the air passage is enlarged in cross-sectional area in the direction normal or substantially normal to the central axis J1, toward the lower side or the upper side in the central axis J1 direction.

In addition, although in the preferred embodiment shown in FIGS. 1 and 2, the sloping surfaces 11*a*1 and 11*b*1 are provided in portions other than the four corners of the air channel portion 10, the sloping surfaces 11*a*1 and 11*b*1 are angled very slightly, and therefore, the air volume characteristics will not be greatly affected even if the sloping surfaces 11*a*1 and 11*b*1 are not provided. Consequently, the presence or absence of the sloping surfaces 11*a*1 and 11*b*1 is not specifically required.

In the central axis J1 direction, a straight surface 11*c* is provided between the sloping surfaces 11*a* and 11*b*. Along the straight surface 11*c*, the distance between the central axis J1 and the inner peripheral surface of the air channel portion 10 is substantially constant at any point on the inner peripheral surface. The air channel portion 10 is preferably formed with molds through injection molding, however, any other desirable forming method could be used. When forming the air channel portion 10, the straight surface 11*c* is provided with a slight sloping surface such that the distance from the central axis J1 is increased toward the upper side. This slope is referred to as a draft angle that is set in consideration of release of the molded article from the molds, and has little influence on the air volume characteristics of the axial fan A.

On the radially inner side of the air channel portion 10, abase 12 is disposed to support and fix the motor 3. More specifically, the base 12 is disposed at a position corresponding to the lower end of the air channel portion 10 in the central axis J1 direction. The base 12 has a covered and substantially cylindrical shape centered at the central axis J1. At the center of the base 12, a bearing housing 12*a* having a covered and substantially cylindrical shape centered at the central axis J1 is provided. A sleeve 34 constituting a bearing to be described later is supported on the inner peripheral surface of the bearing housing 12*a*.

Preferably, four support ribs 13, for example, project radially outward from the outer surface of the base 12. Further, on the outer surface of the base 12, the support ribs 13 are arranged circumferentially with respect to the central axis J1. The support ribs 13 are coupled to the inner peripheral surface of the air channel portion 10 on the radially outer side. More specifically, the support ribs 13 are coupled to the sloping surfaces 11*b* that constitute the inner peripheral surface of the air channel portion 10. Thus, the base 12 is supported to the air channel portion 10 through the support ribs 13. The air channel portion 10, the base 12, and the support ribs 13 are preferably formed unitarily and continuously with one another through injection molding. The material used therefore is preferably a resin, however any other desirable material could be used. For example, the air channel portion 10, the base 12, and the support ribs 13 may be formed unitarily and continuously with one another through die casting using an aluminum alloy, for example.

The sleeve 34 is preferably fixed within the bearing housing 12*a*. The sleeve 34 receives the shaft 32. The sleeve 34 rotatably supports the shaft 32 in order to provide a bearing. The sleeve 34 is a cylindrical member of a porous material, such as a sintered compact impregnated with lubricant oil. The sleeve 34 is impregnated with lubricant oil, so that the lubricant oil is supplied within a radial gap between the inner peripheral surface of the sleeve 34 and the shaft 32. That is, the sleeve 34 rotatably supports the shaft 32 through the lubricant oil. It should be noted that the bearing is not limited to the above-described sliding bearing using the sleeve 34 that supports the shaft 32 rotatably through lubricant oil. For example, a rolling bearing, such as a ball bearing may also be used. The kind of bearing member may appropriately be chosen in view of properties required with the axial fan A and its costs.

A substantially cylindrical rotor magnet 33 is fixed on the inner peripheral surface of the rotor yoke 31. The rotor magnet 33 is magnetized such that a plurality of magnetic poles are arranged alternately in a circumferential direction. A stator is disposed on the inner side of the rotor magnet 33. The stator includes a stator core 35, coils 37, an insulator 36, and a circuit board 38. The stator core 35 is supported on the outer surface of the bearing housing 12*a*. A copper wire is wound on the stator core 35 with the insulator 36 interposed therebetween in order to provide the coils 37. The circuit board 38 is preferably disposed on the lower end of the stator core 35. The circuit board 38 preferably includes a rotation control circuit to control the rotation of the impeller 2.

On the circuit board 38, the rotation control circuit is configured by mounting the terminals of electronic components (not shown) and the coils 37 on a printed circuit board. A current supplied from an external power source (not shown) is passed through the coils 37 by way of the electronic components such as, for example, ICs, Hall elements, etc., so that magnetic fluxes that are produced on the outer peripheral surface of the stator core 35 can be controlled. By controlling the magnetic fluxes, torque is generated around the central axis J1 through the interaction between the magnetic fluxes produced on the outer peripheral surface of the stator core 35 and the magnetic fluxes provided by the rotor magnet 33. This torque then causes the impeller 2 to rotate about the central axis J1.

The structure of the impeller 2 will be detailed below. As shown in FIG. 1, the impeller 2 includes an impeller cup 22 having a covered and substantially cylindrical shape and the blades 21 that produce an airflow by rotating about the central axis J1. As shown in FIG. 2, the blades 21 are arranged on the outer surface of the impeller cup 22 so as to surround the central axis J1 at equal intervals in the circumferential direction. The rotation of the impeller 2 forces air downward (a downward direction in FIG. 1) so as to produce an air current in the central axis J1 direction.

Figure 3:
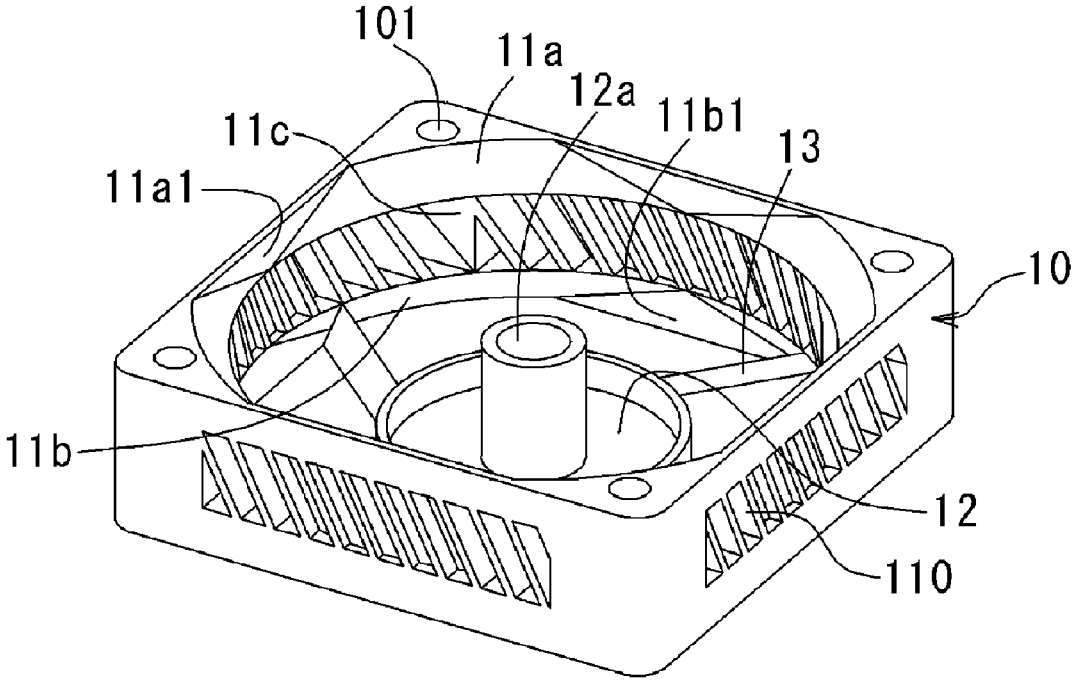
FIG. 3 is a perspective view of an air channel portion of an axial fan according to a preferred embodiment of the present invention.
Figure 4:
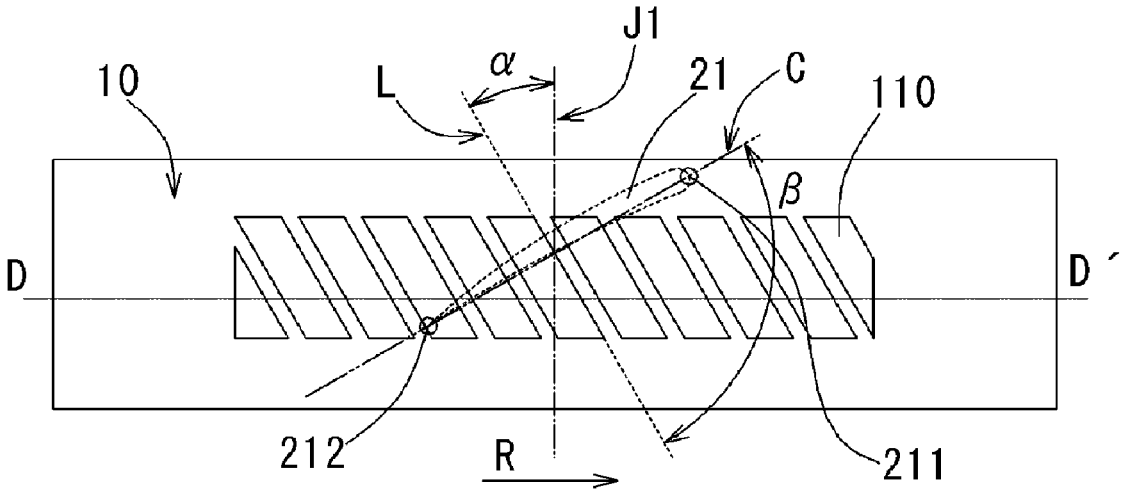
FIG. 4 is a plan view of the air channel portion according to a preferred embodiment of the present invention as viewed from the radially outer side.

The air channel portion 10 will be detailed next. FIG. 3 is a perspective view showing the air channel portion 10 of the axial fan A. In the figure, the motor 3, the impeller 2, and the like are not shown for convenience sake. FIG. 4 is a plan view of the air channel portion 10 as viewed from the radially outer side. As shown in FIG. 3, a plurality of slits 110 are provided in the straight surface 11*c* of the air channel portion 10 so as to penetrate radially outward. As shown in FIG. 4, the respective longitudinal directions of the slits 110 are inclined at an angle $\alpha$ with respect to the central axis J1. A preferred inclination angle $\alpha$ is an angle from about zero degree to an angle smaller than about 90 degrees. FIG. 4 also shows (with a dashed outline) a blade 21 as viewed from the radially outer side. Assume that a blade chord C of the blade 21 is a line linking a front edge 211 at the very front in a rotation direction R of the blade 21 and a rear edge 212 at the very back in the rotation direction R. In this case, the slits 110 are arranged such that the blade chord C of the blade 21 and the longitudinal direction L of each slit 110 make an angle $\beta$ greater than about 90 degrees. The slits 110 are preferably arranged over the entire region of the straight surface 11*c* in the central axis J1 direction. However, the slits can be arranged over less than the entire region of the straight surface 11*c* in the central axis J1 direction. It should be noted that although the slits 110 in the present preferred embodiment are provided only in a portion corresponding to the straight surface 11*c*, the slits 110 may also be provided into the sloping surfaces 11*a*, 11*a*1, 11*b*, and 11*b*1.

The airflow that is produced upon the rotation of the blades 21 around the central axis J1 is in a direction at an angle greater than about 90 degrees with respect to the blade chord C of the blade 21. While the blades 21 rotate around the central axis J1, the air entering the axial fan A is not parallel to the blade chord C but is angled relative to the blade chord C. This angle is called an angle of attack. The angle of an airflow driven out downward by the blades 21 during the rotation of the blades 21 around the central axis J1 is an angle given by adding the angle of attack to a direction normal or substantially normal to the blade chord C. Therefore, the airflow is at an angle greater than about 90 degrees relative to the blade chord C.

The impeller 2 rotates about the central axis J1, and air retained on the upper side in FIG. 1 flows toward the lower side in FIG. 1. At this time, the air retained on the upper side of the axial fan A is taken into the air channel portion 10, passing the inner peripheral surface of the air channel portion 10, i.e., the sloping surfaces 11*a* and 11*a*1. The inner peripheral surface of the air channel portion 10 provides the air passage with a smaller cross-sectional area in the direction normal or substantially normal to the central axis J1 at the straight surface 11*c* portion than at the portions provided with the sloping surfaces 11*a*, in the central axis J1 direction. According to the Bernoulli theorem, the airflow passing along the straight surface 11*c* is faster than the airflow passing along the sloping surfaces 11*a*. Because the airflow becomes fastest when passing along the straight surface 11*c* in comparison with other regions, pressure in the straight surface 11*c* region becomes negative against the ambient pressure of the air channel portion 10. Due to this effect, air is taken through the slits 110 toward the inner peripheral surface side of the air channel portion 10.

The current direction of the airflow that is drawn in through the slits 110 to the inner peripheral surface side of the air channel portion 10 is substantially equal to the current direction of the airflow that the blades 21 drive out toward the lower side in the central axis J1 direction. The flow passage resistance against the airflow passing through the slits 110 becomes smallest at the point where the airflow is parallel or substantially parallel to the longitudinal directions L of the slits 110. As such, the longitudinal directions L of the slits 110 are preferably parallel or substantially parallel to the current direction of the airflow that is driven out by the blades 21 toward the lower side in the central axis J1 direction.

The longitudinal directions L of the slits 110 therefore are preferably at an angle greater than about 90 degrees relative to the blade chord C of each blade 21. The slits 110 are preferably provided in four outer peripheral surfaces corresponding to respective sides of the air channel portion 10 having a substantially quadrangular outer shape. However, the slits 110 can be provided in less than the four outer peripheral surfaces.

FIG. 4 shows one of the four outer peripheral surfaces of the air channel portion 10 as viewed from the outer side in a direction normal to the outer peripheral surface. FIG. 4 also shows a dashed outline of a blade 21 which is closest to the outer peripheral surface. In FIG. 4, assume that the angle formed by the longitudinal direction L of a slit 110 and the blade chord C is $\beta$. The angle $\beta$ in this case is greater than about 90 degrees. A plurality or all of the slits 110 provided in a single outer peripheral surface are substantially equal to one another in their longitudinal directions L, with the longitudinal direction L of the slit 110 set as a standard. With this structure, air is taken efficiently through the slits 110 from the outside of the air channel portion 10. The slits 110 are preferably arranged similarly in the other outer peripheral surfaces. It should be noted that if, in attaching the axial fan A to an electronic device, the air channel portion 10 has an outer peripheral surface which is to be covered by a portion of the electronic device, or if the air channel portion 10 has an outer peripheral surface which is to be covered by another axial fan that is disposed in parallel, that outer peripheral surface may be provided without the slits. In addition, even if the longitudinal directions L of the slits 110 are not parallel or substantially parallel to one another, air outside of the air channel portion 10 will be efficiently taken through the slits 110 toward the inner peripheral surface side of the air channel portion 10. The number of slits 110 to be provided in the air channel portion 10 is not particularly limited, and air that is taken from the outside of the air channel portion 10 through the slits 110 toward the inner peripheral surface side of the air channel portion 10 is increased in amount with the increase in opening area provided by the slits 110.

Figure 5:
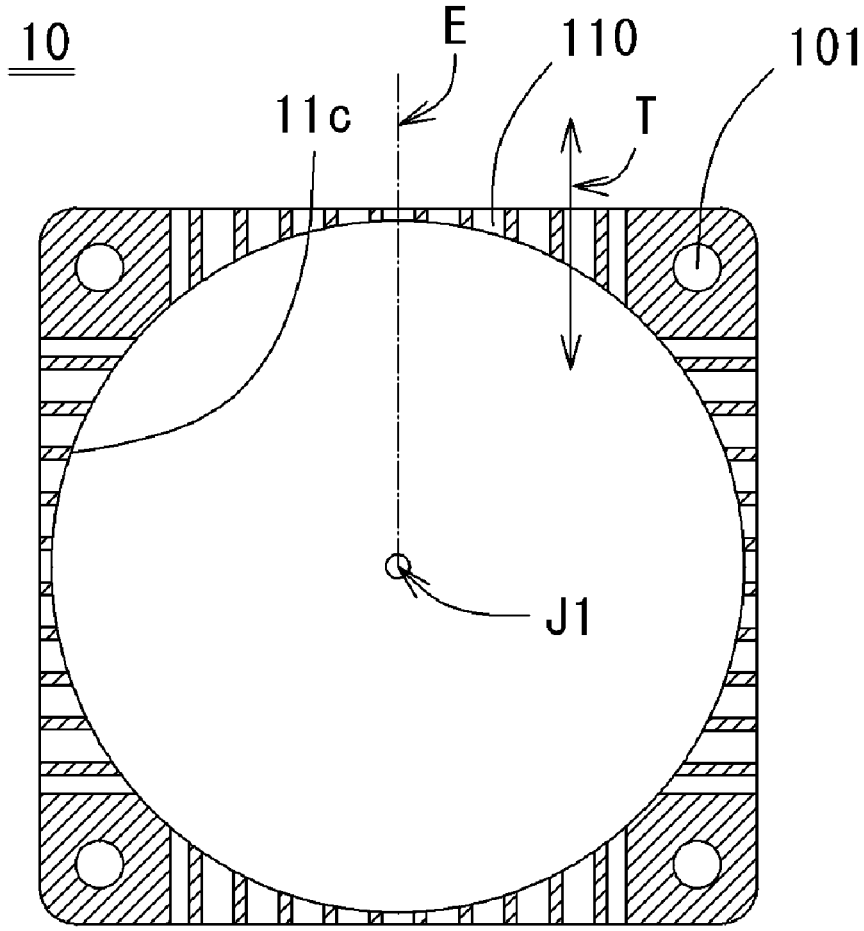
FIG. 5 is a cross-sectional view showing a cross section of the air channel portion according to a preferred embodiment of the present invention, taken along line D-D' in FIG. 4.

FIG. 5 is a cross-sectional view showing a cross section of the air channel portion 10 taken along line D-D' in FIG. 4. As shown in FIG. 5, a penetrating direction T of the slits 110 is parallel or substantially parallel to each direction E that is normal or substantially normal to the outer peripheral surfaces corresponding to sides of the outer shape of the air channel portion 10. Penetrating directions T of the slits 110 provided in each single outer peripheral surface are parallel or substantially parallel to each direction E that is normal or substantially normal to the outer peripheral surfaces. The penetrating directions T of the slits 110 provided in each of the outer peripheral surfaces are parallel or substantially parallel to one another. This structure aligns airflows that enter through the slits 110 from the outer peripheral surface side to the inner peripheral surface side of the air channel portion 10 such that the directions of the airflows become substantially constant. Thus, air is efficiently taken through the slits 110 into the air channel portion 10.

Figure 6:
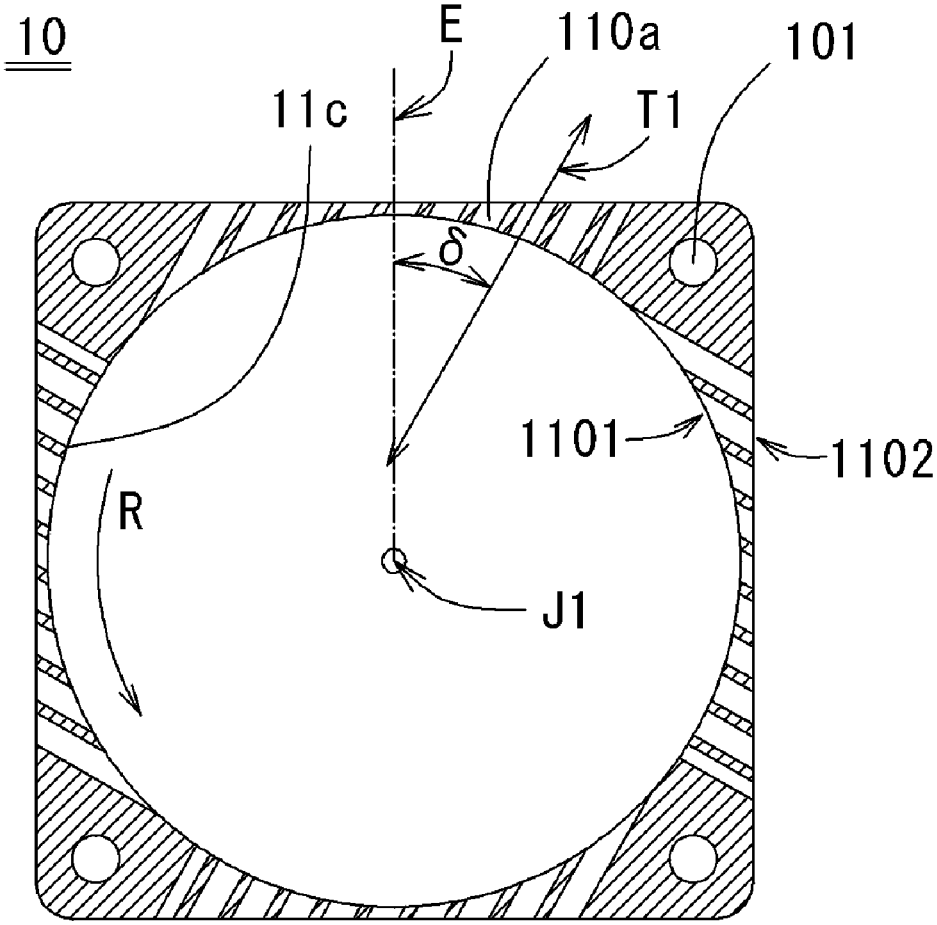
FIG. 6 is a cross-sectional view showing a cross section of the air channel portion of FIG. 5 according to another preferred embodiment of the present invention.

FIG. 6 is a cross-sectional view showing a cross section of the air channel portion 10 according to another preferred embodiment of the present invention. As shown in FIG. 6, a penetrating direction T1 of slits 110*a* is angled at δ relative to each direction E that is normal or substantially normal to the outer peripheral surfaces corresponding to sides of the outer shape of an air channel portion 10*a*. Penetrating directions T1 of the slits 110*a* provided in each single outer peripheral surface are angled at δ relative to each direction E that is normal or substantially normal to the four outer peripheral surfaces. The penetrating directions T1 of the slits 110*a* provided in each of the outer peripheral surfaces are angled at δ relative to the respective directions E that are normal or substantially normal to the outer peripheral surfaces. This structure aligns airflows that enter through the slits 110*a* from the outer peripheral surface side to the inner peripheral surface side of the air channel portion 10*a* such that the directions of the airflows become substantially constant. Thus, air is efficiently taken into the air channel portion 10*a* through the slits 110*a*.

The angle δ will be explained below. Although the impeller 2 is not shown in FIG. 6, as shown in FIG. 6, the rotation direction R of the impeller 2 is counterclockwise. In contrast, the penetrating direction T1 is provided such that an opening 1102 on the radially outer side is inclined, in an opposite direction to the rotation direction R of the impeller 2, from an opening 1101 on the radially inner side with respect to each direction E that is normal or substantially normal to the outer peripheral surfaces. The airflow that is produced by the rotation of the impeller 2 includes circling components in substantially the same direction as the rotation direction R of the impeller 2. Therefore, it is ideal to bring the airflows that pass through the slits 110*a* into the rotation direction R of the impeller 2 as closely as possible.

As shown in FIGS. 3, 5, and 6, the slits 110 and 110*a* are preferably not provided in the respective four corners of the outer shapes of the air channel portions 10 and 10*a*, each being viewed from the radially outer side. This is because there are attachment holes 101 used to attaching the axial fan A to an electronic device provided at the four corners of the respective outer shapes of the air channel portions 10 and 10*a*. The attachment holes 101 are preferably shaped so as to penetrate the four corners of the air channel portions 10 and 10*a*. In a case where the slits 110 and 110*a* are provided in the four corners of the air channel portions 10 and 10*a*, air does not pass through the slits 110 and 110*a* provided in the four corners of the air channel portions 10 and 10*a* when fixtures such as screws are inserted in the attachment holes 101.

As apparent from FIG. 3, the air channel portion 10 preferably has a substantially quadrangular shape at both the upper and lower ends in the central axis J1 direction. This shape is chosen in view of the strength of the air channel portion 10. Although in the preferred embodiment shown in FIG. 3, the outer peripheral surfaces of the air channel portion 10 are each preferably provided in a planar surface, the air channel portion 10 may have such a shape as to be substantially uniform in radial thickness so as to conform with the shape of the inner peripheral surface of the air channel portion 10.

The air channel portions 10 and 10*a* as have been described in the foregoing preferred embodiments are chosen in consideration of the strength of the air channel portions 10 and 10*a* and the volume and efficiency of air intake through the slits 110 and 110*a*.

Figure 7:
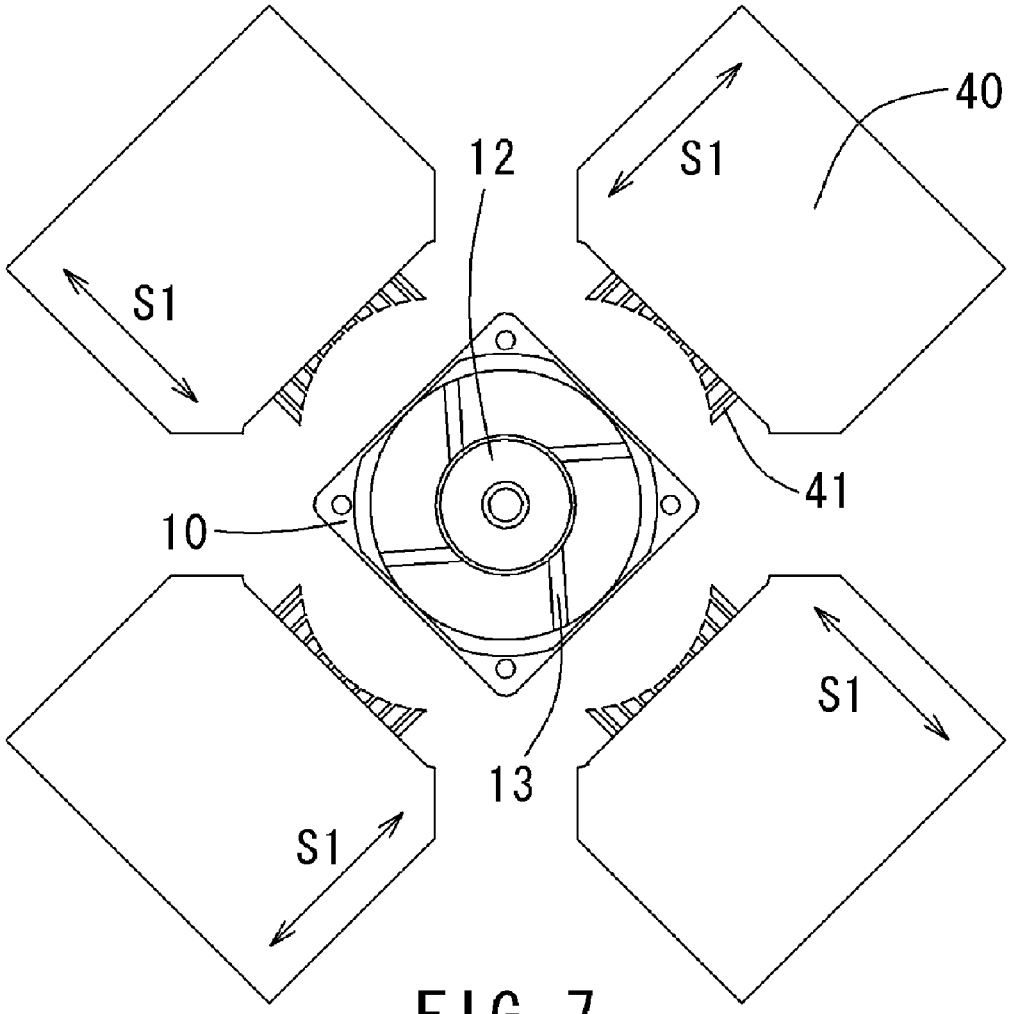
FIG. 7 is a plan view of molds for molding the air channel portion according to a preferred embodiment of the present invention.
Figure 8:
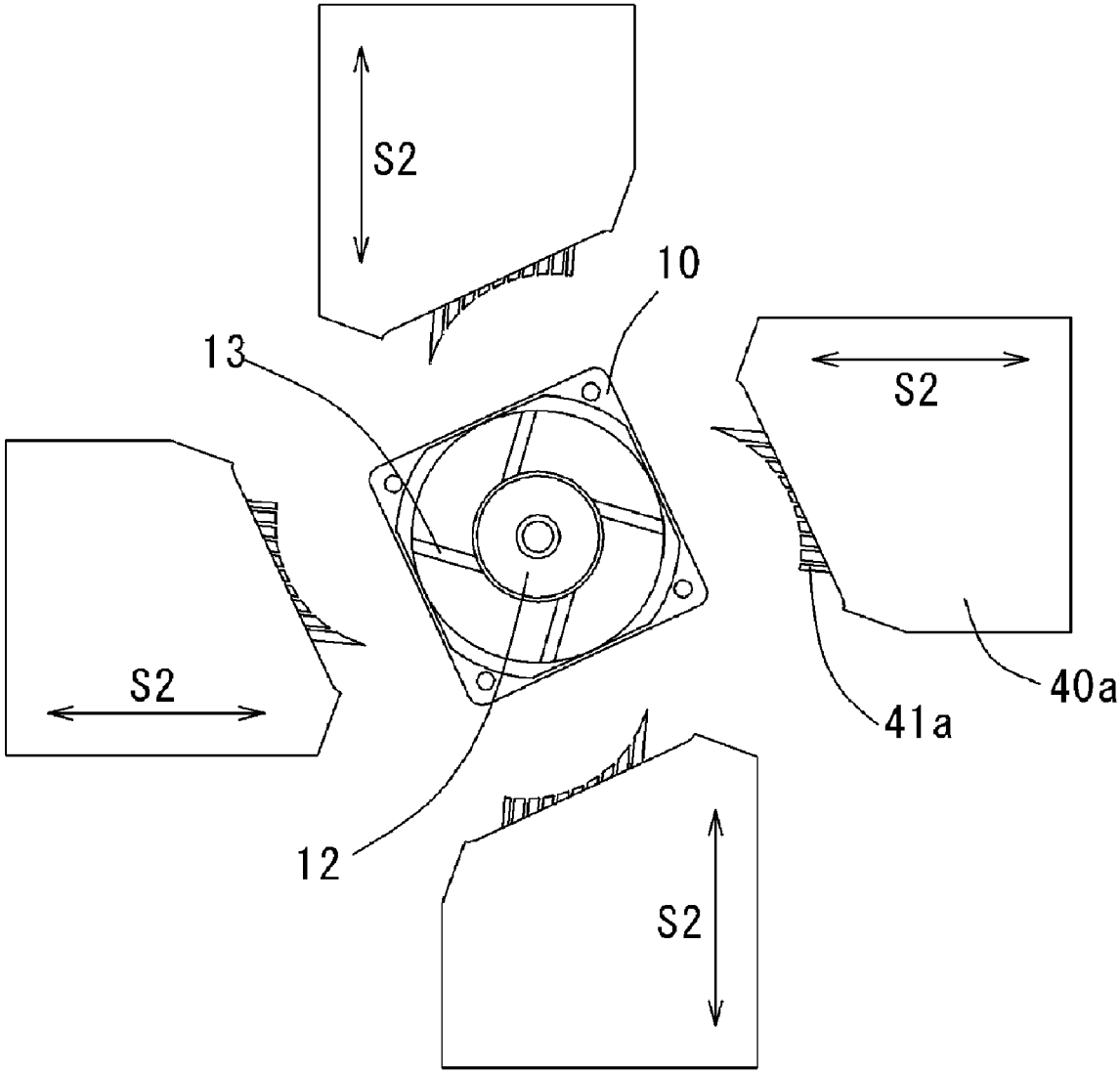
FIG. 8 is a plan view of molds arranged to mold the air channel portion according to another preferred embodiment of the present invention.

A method of molding each of the air channel portions 10 and 10*a* will be described below. FIG. 7 is a plan view showing molds arranged to mold the air channel portion 10. FIG. 8 is a plan view showing molds arranged to mold the air channel portion 10*a*.

The air channel portion 10, the support ribs 13, and the base 12 are preferably molded by injection molding using a resin material. The inner peripheral surface of the air channel portion 10, the support ribs 13, and the base 12 in the present preferred embodiment are molded with an upper mold and a lower mold that slide in the central axis J1 direction. The upper and lower molds are brought into contact with each other in the central axis J1 direction, whereby a closed space is formed between the upper and lower molds and slide cores 40 to be described later, and a molten resin is injected into the closed space. The closed space is adapted to have the geometry of the air channel portion 10, the support ribs 13, and the base 12. The molten resin is solidified within the closed space, and the upper and lower molds are separated from each other, so that a single unitarily formed air channel portion 10, support ribs 13, and a base 12 can be obtained. As described earlier, the air channel portion 10, the support ribs 13, and the base 12 may be formed by die casting using an aluminum alloy.

For instance, in the case where the air channel portion 10, the support ribs 13, and the base 12 are formed with an aluminum alloy, heat from the motor 3 is transferred to the air channel portion 10 through the base 12 and the support ribs 13. An airflow that passes through the slits 110 allows the heat to be forcedly dissipated. The provision of the slits 110 in the air channel portion 10 increases dissipation area of the air channel portion 10. It is therefore possible to forcedly dissipate heat generated in the motor 3.

The slits 110, however, cannot be molded with only the upper and lower molds that slide in the central axis J1 direction. The slits 110 fall upon blind spots when the air channel portion 10 is viewed in the sliding direction of the upper and lower molds, i.e., the central axis J1 direction. Those portions that fall upon blind spots as viewed in the sliding direction of the upper and lower molds cannot be molded with only the upper and lower molds.

Accordingly, as shown in FIG. 7, the slits 110 are preferably formed with four slide cores 40. The four slide cores 40 each slide in a direction parallel or substantially parallel to each direction substantially normal to the four outer peripheral surfaces of the air channel portion 10. Each slide core 40 preferably includes a plurality of slit forming portions 41 projecting radially inward. The slide cores 40 slide in a direction normal or substantially normal to the central axis J1 in conjunction with the slide movement of the upper and lower molds. While the upper and lower molds meet each other in the central axis J1 direction, the slide cores 40 cover the interface between the upper and lower molds and the vicinity thereof from the radially outer side. That is, the outer peripheral surfaces of the air channel portion 10 are formed by the slide cores 40. The above slit forming portions 41 take their positions within the closed space formed by the mutual contact between the upper and lower molds and the slide cores 40. The slit forming portions 41 extend up to portions of the upper and lower molds, the portions to form the inner peripheral surface of the air channel portion 10. When a molten resin is injected into the closed space formed by the molds, the resin fills the space avoiding the slit forming portions 41. That is, the portions situated within the closed space and corresponding to the slit forming portions 41 form the slits 110 of the air channel portion 10. When the upper and lower molds are separated from each other in the central axis J1 direction, each of the four slide cores 40 is slid in the radially outward direction to be positioned at separate positions from the upper and lower molds.

As described above, the slits 110 are formed by using the slide cores 40. That is, the slits 110 penetrate in directions equal to respective sliding directions S1 of the slide cores 40. The shape, arrangement, and number of the slits 110 are easily changeable by modifying the slit forming portions 41 of the slide cores 40.

In the case of forming the air channel portion 10*a* in which the slits 110*a* penetrate in the penetrating directions T1 that are inclined relative to the directions E that are normal or substantially normal to the outer peripheral surfaces, respectively, of the air channel portion 10*a* as shown in FIG. 6, as shown in FIG. 8, sliding directions S2 of slide cores 40*a* may be inclined from the directions E that are normal or substantially normal to the outer peripheral surfaces, respectively, of the air channel portion 10*a*. That is, not only the shape and number but also the penetrating directions of the slits 110*a* are changeable by alteration of the sliding directions S2 of the slide cores 40*a*.

Next, a description is given of air volume characteristics of the axial fan A obtained by the introduction of air through the slits 110 and 110*a*. The air volume characteristics described herein refer to characteristics relating to the air volume and static pressure of the axial fan. A general axial fan produces a maximum air volume when the axial fan itself is not under load (static pressure). In addition, an axial fan provides a maximum static pressure when the air volume is zero. As a load (static pressure) is gradually applied to the axial fan, the air volume value gradually falls. In axial fans, surging occurs in an intermediate static pressure zone between the zero static pressure and the maximum static pressure. The surging herein refers to a phenomenon in which air flowback in a particular intermediate static pressure zone causes the produced air volume to be unstable.

The provision of the slits 110 in the air channel portion 10 permits intake of air through the slits 110 which acts to prevent flowback from the lower opening of the air channel portion 10 to thereby suppress an occurrence of the surging. Consequently, the air volume value of the axial fan A can be improved in the intermediate static pressure zone.

Figure 9:
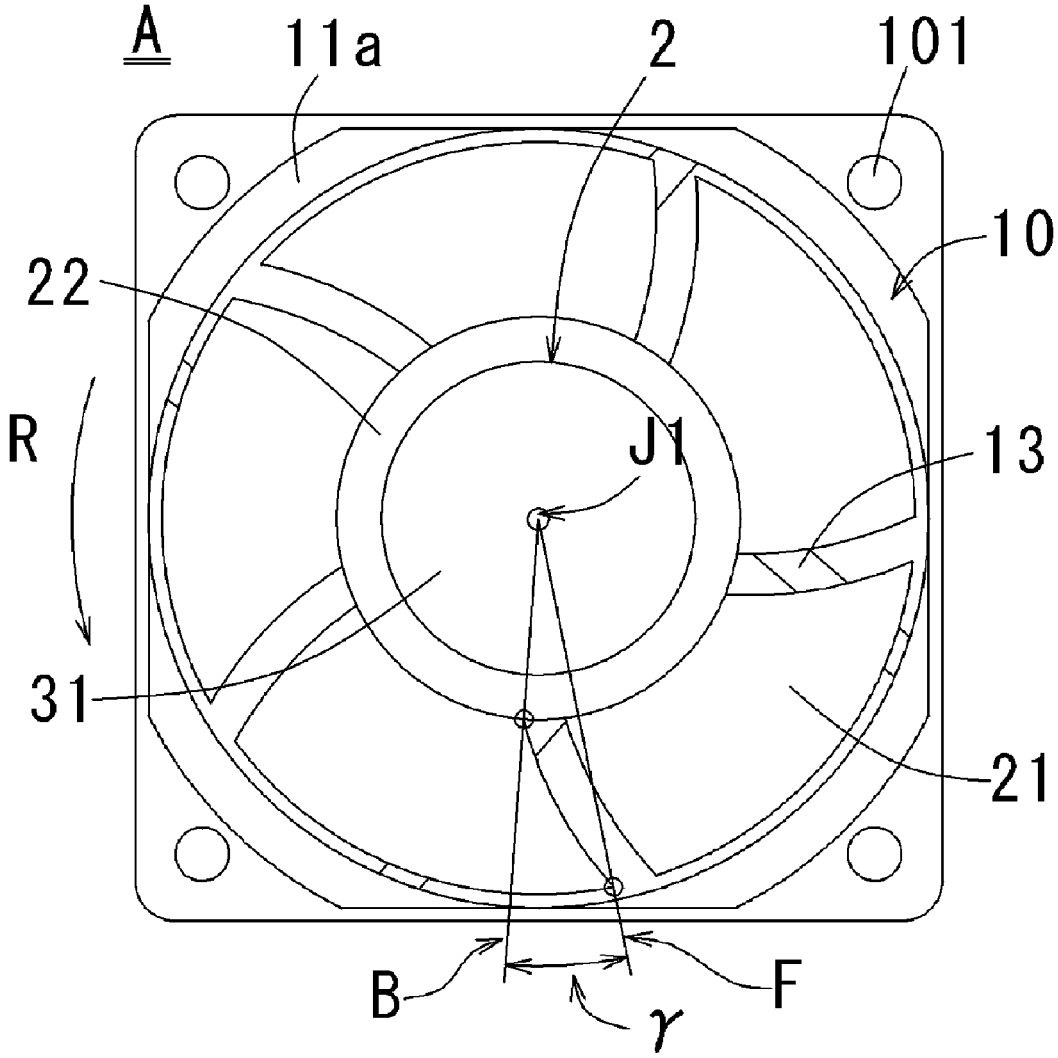
FIG. 9 is a plan view illustrating a slant of a front edge of a blade according to a preferred embodiment of the present invention.

FIG. 9 is a plan view showing slant of the front edge 211 of a blade 21 according to a preferred embodiment of the present invention. In order to further reduce the surging, the intake volume through the slits 110 has to be increased. Hence, the impeller 2 of the axial fan A of the present preferred embodiment is constructed as described below. Each of the blades 21 has the front edge 211 at the front in the rotation direction R and the rear edge 212 at the back in the rotation direction R (shown in FIG. 4). The intersection of the front edge 211 with the impeller cup 22 and the central axis J1 are linked with a straight line B. The tip end of the front edge 211 on the radially outer side and the central axis J1 are linked with a straight line F. In this case, the straight line F is at an advanced position in the rotation direction R with respect to the straight line B. Generally, blades that are constructed in this configuration are referred to as forward swept blades.

The rotation of the blades 21, which preferably are forward swept blades, around the central axis J1 reduces centrifugal components that flow radially outward in an airflow. That is, the airflow produced by the blades 21 becomes an airflow along a current direction that approximates the central axis J1. Where an airflow contains strong centrifugal components, the centrifugal components are contained in the airflow produced in the vicinity of the slits 110 by the blades 21. For this reason, the airflow produced by the blades 21 may hinder the air taken through the slits 110. However, by adopting the forward swept blades, the airflow produced by the blades 21 hardly hinders the intake of air through the slits 110. As such, the intake of air through the slits 110 can be promoted. Particularly, a structure having an angle γ formed by the straight lines F and B preferably set from about 20 degrees to about 30 degrees, for example, is desirably adopted by the forward swept blades.

Figure 10:
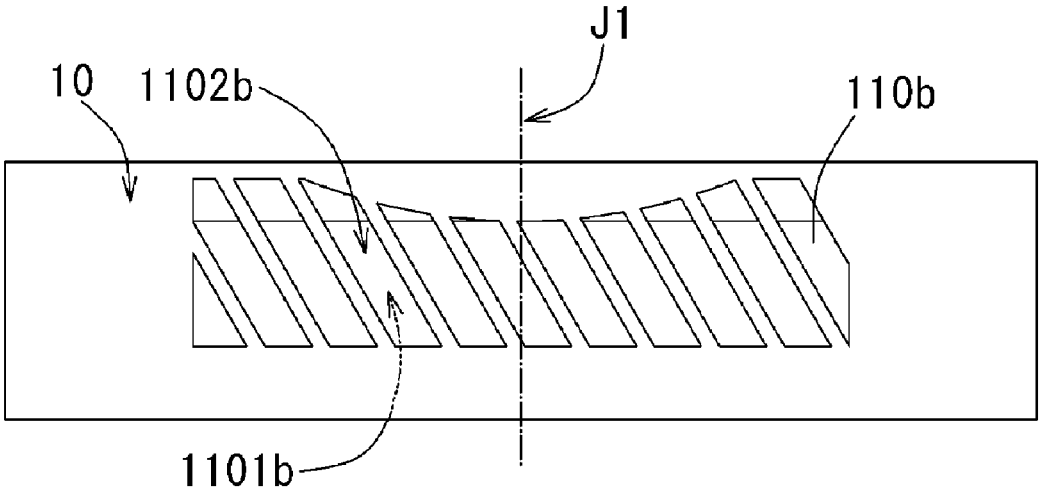
FIG. 10 is a plan view showing slits according to another preferred embodiment of the present invention, with the air channel portion viewed from the radially outer side.

FIG. 10 shows a plan view of the slits in an outer peripheral surface of the air channel portion 10 as viewed from the radially outer side, according to another preferred embodiment of the present invention. As shown in FIG. 10, an opening 1102*b* on the outer peripheral surface side is larger in opening area than an opening 1101*b* on the inner peripheral surface side of the air channel portion 10, in each slit 110*b*. The radial thickness of the air channel portion 10 gradually becomes larger toward the four corners. In accordance therewith, the length of each slit in the penetrating direction becomes gradually longer toward the four corners. By providing a larger opening area at the opening 1102*b* on the outer peripheral surface side of the air channel portion 10 than at the opening 1101*b* on the inner peripheral surface side, more air can be taken from the outer peripheral surface side of the air channel portion 10. That is, the opening area of the opening 1102*b* on the outer peripheral surface side of the air channel portion 10 is made larger in slits 110*b* near the four corners than in slits 110*b* near the respective centers of the outer peripheral surfaces, thereby allowing increase in intake volume through the slits 110*b* toward the inner peripheral surface side of the air channel portion 10.

While preferred embodiments of the present invention have been described above, these are illustrated only by way of example, and it is to be understood that variations and modifications will be apparent to those skilled in the art without departing the scope and spirit of the present invention. The scope of the present invention, therefore, is to be determined solely by the following claims.

What is claimed is:

1. A fan comprising:

an impeller including a plurality of blades centered about a central axis and projecting radially outward from the central axis in such a way as to be arranged circumferentially about the impeller;

a motor that rotates the impeller about the central axis;

a base supporting the motor;

an air channel portion enclosing the impeller from a radially outer side to provide an air passage; and a plurality of supports projecting radially outward from the base and fixedly coupled to the air channel portion; wherein the air channel portion includes an upper opening at a first end and a lower opening at a second end, in a direction of the central axis, the air channel portion further including a plurality of outer peripheral surfaces with ones of the plurality of outer peripheral surfaces being perpendicular to other ones of the plurality of outer peripheral surfaces;

each of the upper and lower openings includes a sloping region in which the air passage is increased in cross-sectional area toward each open end in a direction substantially normal to the central axis;

a straight portion is provided between the upper and lower openings along which the air passage is substantially constant in cross-sectional area in the direction substantially normal to the central axis direction;

the straight portion includes a plurality of slits defined by substantially straight channels penetrating radially and arranged circumferentially with respect to the central axis to allow flow of air between a radially inner side and a radially outer side of the air channel portion;

the slits are provided in each of the plurality of outer peripheral surfaces, a penetrating direction of each of the slits is inclined from a straight line that is normal or substantially normal to each of the plurality of outer peripheral surfaces in a direction opposite to a rotation direction of the impeller; and the penetrating directions of the slits are parallel or substantially parallel to one another in each respective one of the plurality of outer peripheral surfaces.

2. The fan according to claim 1, wherein each of the slits extends in the central axis direction over an entire region of the straight portion.

3. The fan according to claim 2, wherein at least a portion of each of the slits extends from the straight portion into the sloping regions.

4. The fan according to claim 1, wherein the air channel portion includes a substantially quadrangular outer periphery when viewed in the central axis direction and at least one of the outer peripheral surfaces corresponds to a side of the outer periphery of the air channel portion.

5. The fan according to claim 4, wherein each of the slits is spaced away from corner portions of the air channel portion.

6. The fan according to claim 4, wherein the air channel portion, the supports, and the base are defined by a single unitary member.

7. The fan according to claim 4, wherein each of the slits includes a larger opening area at the radially outer side than at the radially inner side of the air channel portion.

8. The fan according to claim 7, wherein in each of the outer peripheral surfaces, the air channel portion includes regions in which the opening area at the radially outer side of each of the slits is gradually increased toward corners of the air channel portion.

9. The fan according to claim 1, wherein each of the blades includes a front edge at a very front in the impeller rotation direction and a rear edge at a very back in the rotation direction; and when one of the outer peripheral surfaces is viewed from an outer side in a direction substantially normal to the outer peripheral surface, a straight line linking the front edge at a radially outer end with the rear edge of one of the blades that is closest to the outer peripheral surface forms an angle greater than about 90 degrees with a longitudinal direction of one of the slits that is provided in a position where the blade is closest to the outer peripheral surface.

10. The fan according to claim 1, wherein a dimension of the plurality of slits in the central axis direction is greater than a dimension of the plurality of slits circumferentially with respect to the central axis; and ones of the plurality of slits arranged at circumferentially inner portions of the plurality of outer peripheral surfaces are shorter in the penetrating direction than other ones of the plurality of slits arranged at circumferentially inner portions of the plurality of outer peripheral surfaces.

11. The fan according to claim 10, wherein each of the plurality of slits extends in the central axis direction over an entire region of the straight portion.

12. The fan according to claim 11, wherein at least a portion of each of the plurality of slits extends from the straight portion into the sloping regions.

13. The fan according to claim 10, wherein each of the blades includes a front edge at a very front in the impeller rotation direction and a rear edge at a very back in the rotation direction; and when one of the outer peripheral surfaces is viewed from an outer side in a direction normal or substantially normal to the outer peripheral surface, a straight line linking the front edge at a radially outer end with the rear edge of one of the blades that is closest to the outer peripheral surface forms an angle greater than about 90 degrees with a longitudinal direction of one of the plurality of slits that is provided in a position where the blade is closest to the outer peripheral surface.

14. The fan according to claim 10, wherein each of the plurality of slits is spaced away from corner portions of the air channel portion.

15. The fan according to claim 10, wherein the air channel portion, the supports, and the base are defined by a single unitary member.

16. The fan according to claim 10, wherein each of the plurality of slits includes a larger opening area at the radially outer side than at the radially inner side of the air channel portion.

17. The fan according to claim 16, wherein in each of the outer peripheral surfaces, the air channel portion includes regions in which the opening area at the radially outer side of each of the plurality of slits is gradually increased toward corners of the air channel portion.

18. A method of manufacturing an air channel portion of an axial fan comprising:

an impeller including a plurality of blades centered about a central axis and projecting radially outward from the central axis in such a way as to be arranged circumferentially about the impeller;

a motor that rotates the impeller about the central axis;

a base supporting the motor;

an air channel portion enclosing the impeller from a radially outer side to provide an air passage; and a plurality of supports projecting radially outward from the base and fixedly coupled to the air channel portion; wherein the air channel portion includes an upper opening at a first end and a lower opening at a second end, in a direction of the central axis, the air channel portion further including a plurality of outer peripheral surfaces with ones of the plurality of outer peripheral surfaces being perpendicular to other ones of the plurality of outer peripheral surfaces;

each of the upper and lower openings includes a sloping region in which the air passage is increased in cross-sectional area toward each open end in a direction substantially normal to the central axis;

a straight portion is provided between the upper and lower openings along which the air passage is substantially constant in cross-sectional area in the direction substantially normal to the central axis direction;

the straight portion includes a plurality of slits defined by substantially straight channels penetrating radially and arranged circumferentially with respect to the central axis to allow flow of air between a radially inner side and a radially outer side of the air channel portion;

the slits are provided in each of the plurality of outer peripheral surfaces, a penetrating direction of each of the slits is inclined from a straight line that is normal or substantially normal to each of the plurality of outer peripheral surfaces in a direction opposite to a rotation direction of the impeller; and the penetrating directions of the slits are parallel or substantially parallel to one another in each respective one of the plurality of outer peripheral surfaces; and the air channel portion is formed unitarily with the supports and the base through injection molding using a resin or die casting using an aluminum alloy, and molds used in the molding or the die casting include an upper mold, a lower mold, and a slide core, the method comprising the steps of:

injecting a molten resin or a molten aluminum alloy into a closed space formed by the upper mold, the lower mold, and the slide core;

sliding the upper mold and the lower mold in the central axis direction and the slide core in a direction other than the central axis direction; and releasing the air channel portion from the molds to provide the air channel portion; wherein the supports, the base, and an inner peripheral surface of the air channel portion are formed through the sliding of the upper mold and the lower mold in the central axis direction; and the outer peripheral surfaces and the slits are formed through the sliding of the slide core in respective penetrating directions of the slits.

* * * * *